US005356311A

United States Patent [19]

Liu

[11] Patent Number: 5,356,311

[45] Date of Patent: Oct. 18, 1994

[54] NETWORK WALL PLATE

[76] Inventor: Danny Liu, 3rd Fl., 7 Alley 6, Lane 235, Poa-Chau Road, Hsin-Tien City, Taiwan

[21] Appl. No.: 37,979

[22] Filed: Mar. 25, 1993

[51] Int. Cl.[5] ..... H01R 13/518

[52] U.S. Cl. ..... 439/536; 439/540

[58] Field of Search ..... 439/535–538, 439/540

[56] References Cited

U.S. PATENT DOCUMENTS

| | | | |
|---|---|---|---|
| 4,875,880 | 10/1989 | Welch et al. | 439/536 |
| 5,013,260 | 5/1991 | Caveney et al. | 439/536 |
| 5,131,866 | 7/1992 | Bodenweiser et al. | 439/538 |
| 5,228,869 | 7/1993 | Below | 439/536 |

*Primary Examiner*—Gary F. Paumen
*Attorney, Agent, or Firm*—David G. Conlin; David S. Resnick

[57] ABSTRACT

A network wall plate includes a wall plate shell, a plurality of transmission-line adapting sockets removably installed on the wall plate shell, a plurality of transmission-line connectors which can be respectively plugged into the transmission-line adapting sockets, and two screw bases capable of passing therethrough screws to fix the wall plate onto a wall surface, wherein at least one of the transmission-line connectors can be removably plugged into one of the transmission-line adapting sockets. The present wall plate is designed to be diversified, to have an increased socket density and/or to provide an improved appearance.

14 Claims, 5 Drawing Sheets

NETWORK WALL PLATE

BACKGROUND OF THE PRESENT INVENTION

The present invention relates to a network equipment, and more particularly to a network wall plate. A conventional wall plate (FIG. 1) includes a wall plate shell 1, multiple transmission-line adapting sockets 2, multiple transmission-line connectors 3, screw bases 4 and screw base decorating covers 5, wherein the transmission-line adapting sockets 2 are removably established on the wall plate shell 1, the transmission-line connectors 3 are fixed on the transmission-line adapting sockets, the screw bases 4 are prepared to pass therethrough screws to fix the wall plate on the wall surface, and the screw base decorating covers 5 can conceal the screws screwed through the screw bases 4. Such a wall plate, nevertheless, suffers from the following shortcomings:

1) Since there exists many different types of transmission-lines and terminal equipments, a general-purpose wall plate has been expected to be respectively applied therefor. Conventional transmission-line connectors 3, however, are irremovably fixed on the transmission-line adapting sockets 2 so that they cannot meet with the needs of the various transmission environments.
2) Conventionally, the screw bases 4 are integrally formed to the wall plate shell 1 and occupy a space the same as a transmission-line adapting socket does. Therefore, so far as a conventional wall plate having 3 adapting sockets is concerned, about a quarter valuable space has been occupied inevitably thereby.
3) For a conventional wall plate with four transmission-line sockets, sometimes the four sockets are not fully utilized in real application so that if only three of them are used, then a corresponding space for one of them will be left to reveal wirings provided in the wall plate having thus no longer a relatively nice appearance.

SUMMARY OF THE INVENTION

It is therefore an object of the present invention to provide a network wall plate wherein the adapting sockets can be easily removed from/mounted on the wall plate shell without any tool.

It is therefore another object of the present invention to provide a network wall plate removably installed therewith transmission-line connectors.

It is therefore further an object of the present invention to provide a network wall plate capable of installing thereon more transmission-line sockets.

It is therefore again an object of the present invention to provide a network wall plate capable of staying therewith a good look even though some transmission-line sockets are missing on the wall plate.

According to the present invention, a network wall plate includes a wall plate shell, a plurality of transmission-line adapting sockets, a plurality of transmission-line connectors and two screw bases capable of passing therethrough screws to fix the wall plate shell onto the wall surface. The wall plate is characterized in that at least one of the transmission-line connectors can be removably plugged into one of the transmission-line adapting sockets.

Certainly, the shell can be provided with plural cuts in order that the transmission-line adapting sockets can be easily removed from/mounted to the wall plate shell without any tool.

Certainly, the present network wall plate can have the screw bases being removable so that after they are removed, exactly a space for one more transmission-line adapting socket can be obtained.

Certainly, the present network wall plate can be provided with plural decorating covers capable of concealing the screw bases or concealing a part of the wall plate missing a transmission-line adapting socket.

Certainly, in the present network wall plate the transmission-line connector can be attached to a medium piece capable of being fitted into an empty space of one of the transmission-line adapting sockets for the purpose that the one transmission-line connector can be removably mounted on the one transmission-line adapting socket.

Certainly, the present network wall plate can be provided with plural screw guides lying concealed at the back of the wall plate shell and integrally formed with the wail plate shell so that after the two screw bases are removed, the wall plate can be mounted onto the wall surface thereby.

Certainly, a network wall plate according to the present invention can have the wall plate shell thereof provided with a plurality of screw covers disposed above the screw guides respectively to conceal screws screwed through the screw guides. The number of the wall plate covers can be two and the screw covers are flushly engageable with the wall plate shell.

A network wall plate according to the present invention can have the screw guides and the screw covers thereof been diagonally oppositely or optionally symmetrically located on the wall plate shell.

The cuts of the present network wall plate can be symmetrically located on two inner opposite sides of the wall plate shell.

The present invention may be better understood through the following description with reference to the accompanying drawings, in which:

DETAILED DESCRIPTION OF THE PREFERRED EMBODIMENT

Figure 4:
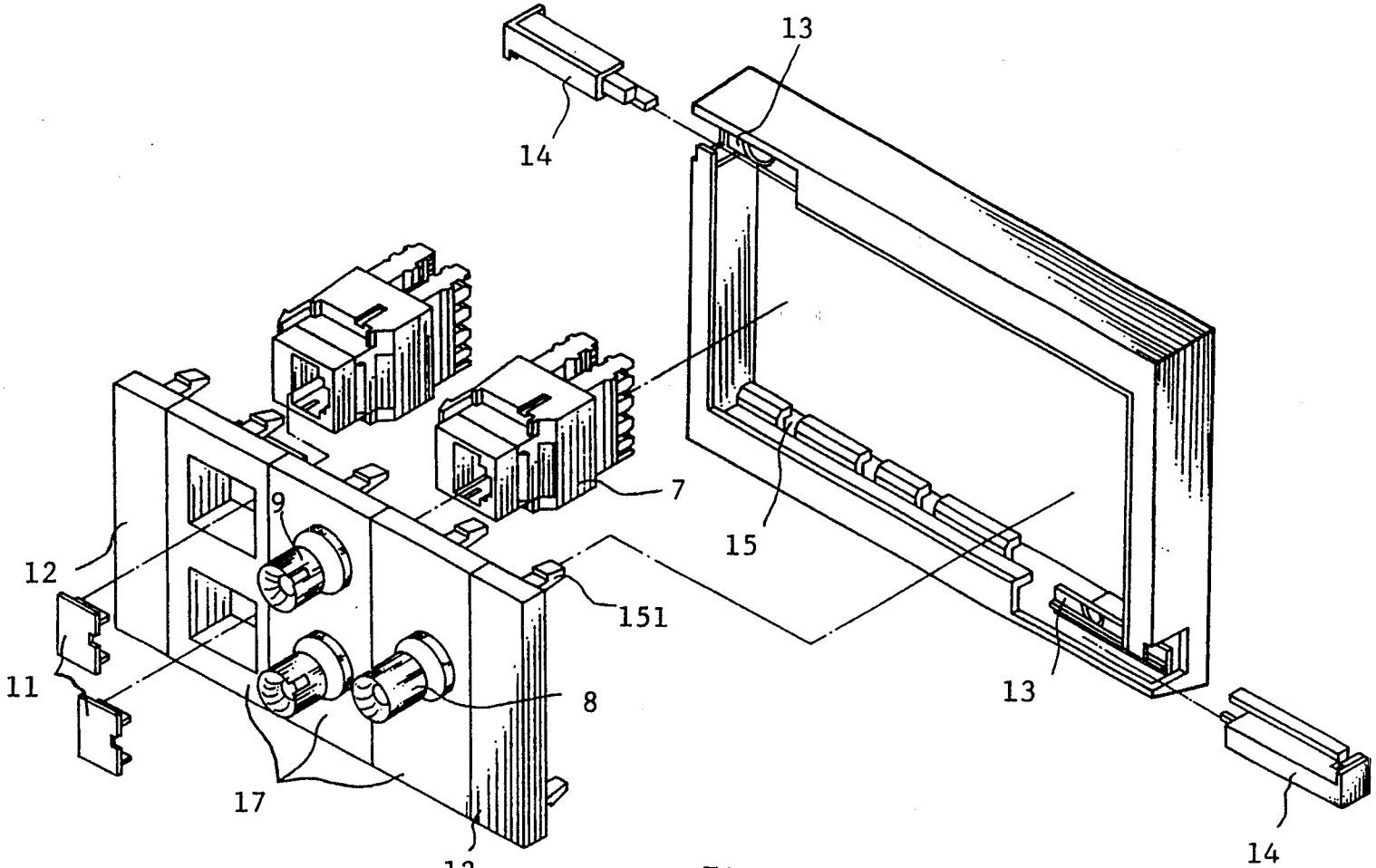
FIG. 4 shows a first preferred embodiment of a wall plate according to the present invention.
Figure 5:
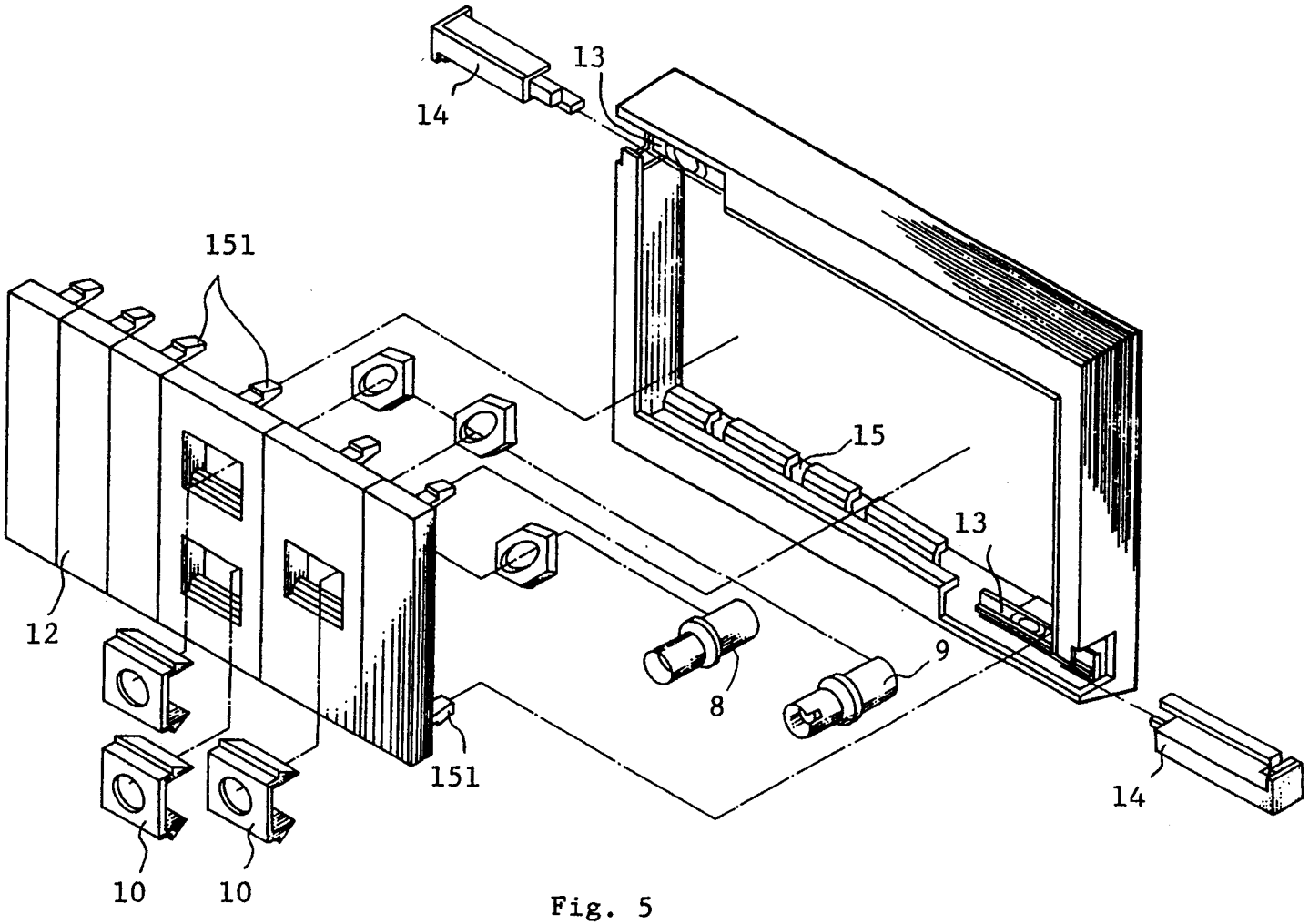
FIG. 5 shows a second preferred embodiment of a wall plate according to the present invention.

According to a preferred embodiment of the present network wall plate, the transmission-line connector instead of being conventionally irremovably mounted on the transmission-line adapting socket, is removably mounted thereon so that the transmission-line connector can be an optic fiber connector, a telephone-line connector, a BNC connector, an F connector (used for the antenna) . . . or the like. As shown in FIG. 4, the transmission-line connector 7 can be a removable modular jack adaptor. Referring to FIG. 5, a BNC connector 8, an F connector, an optic fiber connector 9 . . . or the like can be alternatively replaceably attached to a medium piece 10 capable of being detachably fitted into an empty space of one of the transmission-line adapting sockets 17. Therefore, any transmission-line connector can easily be removably mounted on a predetermined transmission-line socket as desired to enable the present wall plate to be diversified and flexible in application.

If the transmission-line connector is a modular jack adaptor, the present invention can be provided with a dust cover 11 being flush with the wall plate shell.

Figure 1:
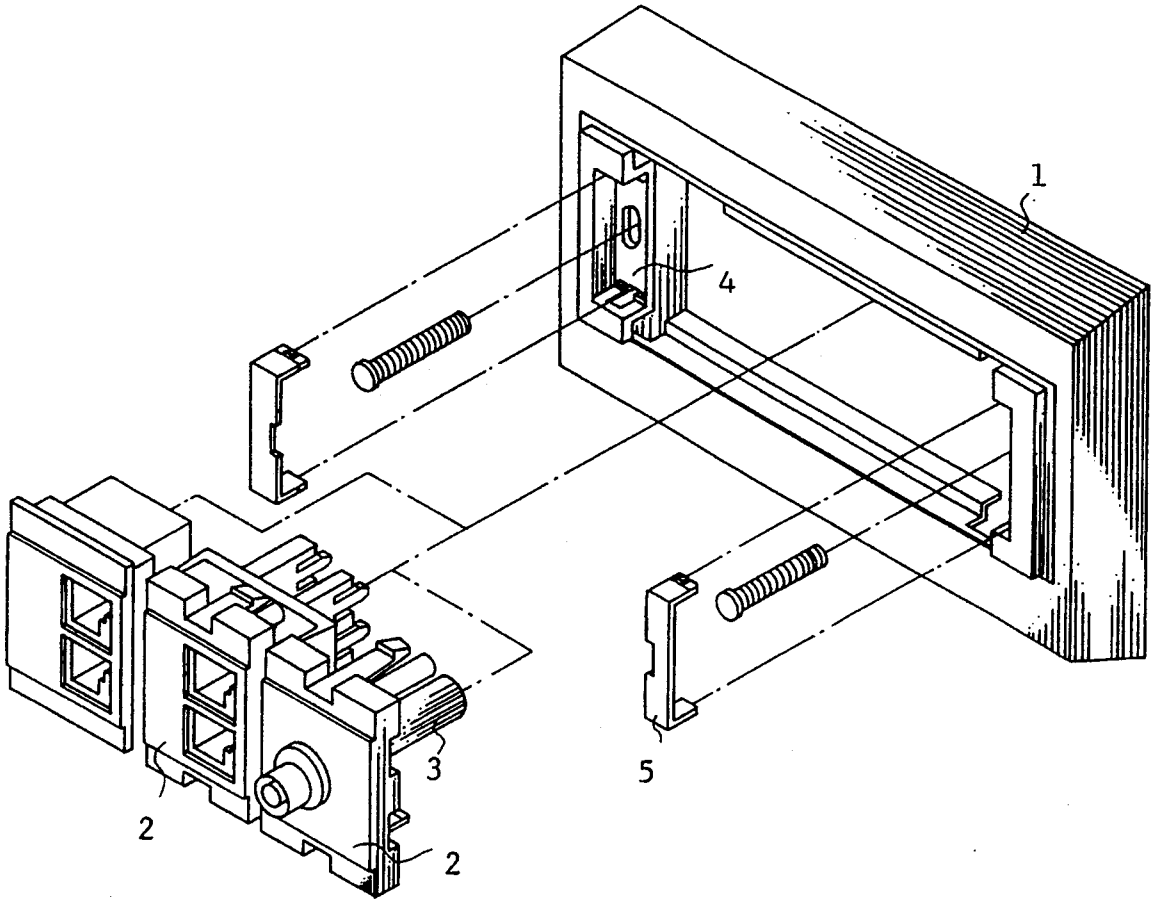
Fig. 1 (PRIOR ART)
FIG. 1 shows an exploded view of the conventional network wall plate.
Figure 2:
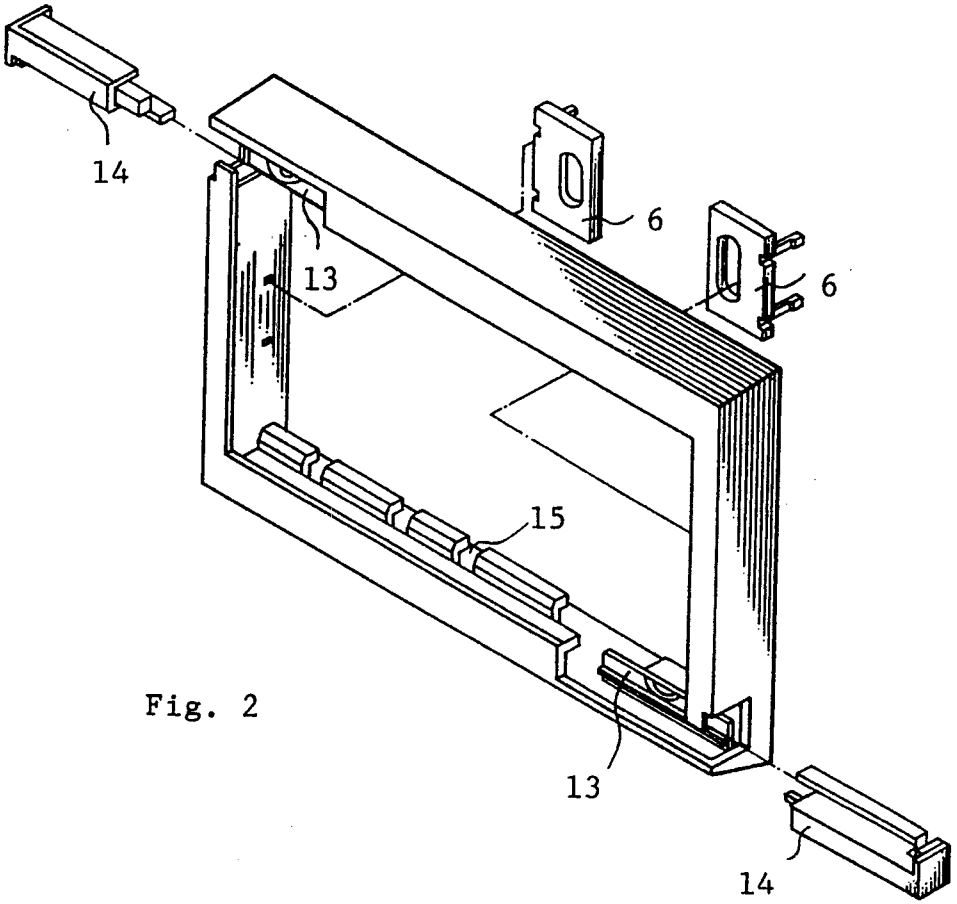
FIG. 2 shows a network wall plate with removable screw bases according to the present invention.
Figure 3:
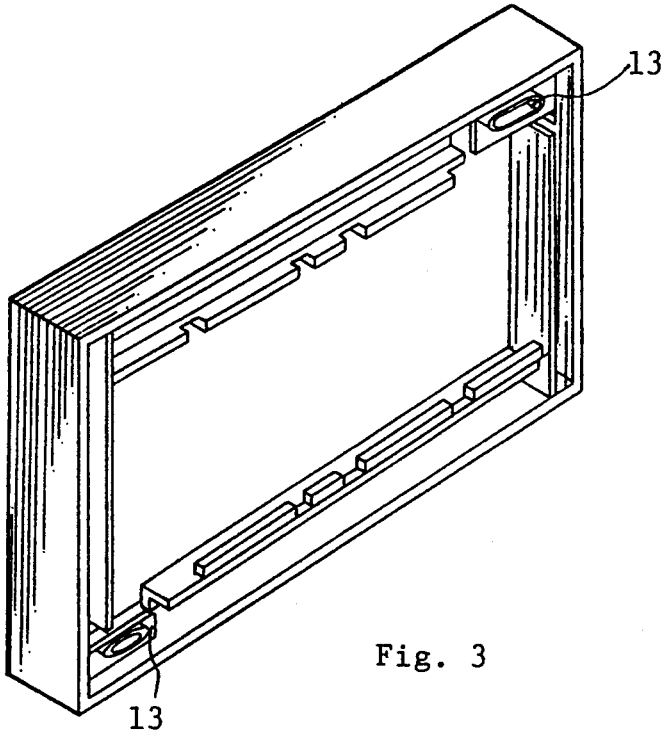
FIG. 3 shows a network wall plate with concealed screw guides according to the present invention.

A wall plate shell according to the present invention, as shown in FIG. 2 has another important improvement made to the fastener bases or screw bases 6 which instead of being conventionally integrally formed to the wall plate shell to thus be space-occupying, is detachably mounted thereto. As shown in FIG. 3, a plurality of screw guides 13 are provided at the back of the wall plate shell to perform the same function as the screw bases do. These lying concealed screw guides 13 can be conveniently integrally formed to the wall plate shell. Therefore, we can optionally or desiredly fix the wall plate shell by means of the screw bases 6 or screw guides 13.

More specifically, if we choose to detach the screw bases from the wall plate shell and utilize the screw guides for fixing the wall plate shell to the wall surface, another transmission-line adapting socket can be fitted into the extra space left by the removed screw bases to increase the space utilization degree.

The conventional wall plate is provided with screw decorating covers 5 used to conceal screws screwed through the screw bases of the wall plate shell but the present invention is removably provided with wall plate covers 12 whose breadth is exactly half of that of a transmission-line adapting socket so that when one of the adapting sockets is missing, the empty space can just accommodate therein two wall plate covers 12 to thus conceal thereunder the wiring provided in the wall.

The present invention is provided with a plurality at the inner sides of the wall plate shell, as shown in FIGS. 2–5 to allow adapting sockets 2 or wall plate covers 12 can be easily disassembled from the wall plate shell without any tool by way of moving the sockets 2 or covers 12 to allow the engaging protrusions 151 thereof to respectively pass therethrough these cuts 15. These cuts can certainly be located on two inner opposite sides of the wall plate shall.

To further modify the present invention, the screw guides 13 as shown in FIGS. 2–5 can be diagonally located on the wall plate shell and can respectively be concealed by screw covers 14 respectively plugged into and flushly engaged with the wall plate shell without occupying any extra space, so that screws screwed through screw guides 13 can be concealed thereby.

While the present invention has been described in connection with what are presently considered as the preferred embodiments, it is to be understood that various modifications can easily be made to the disclosed embodiments by those skilled in the art without departing from the spirit and scope of the appended claims to be broadly interpreted.

What I claim is:

1. A network wall plate comprising:

a wall plate shell;

a plurality of transmission-line adapting sockets removably installed on said wall plate shell;

a plurality of transmission-line connectors which can be respectively plugged into said transmission-line adapting sockets; and two fastener bases capable of passing therethrough fasteners to fix said wall plate onto a wall surface, characterized in that said two fastener bases can be removed to thus obtain an extra space capable of exactly fitting therein one or more of said transmission-like sockets.

2. A wall plate according to claim 1, wherein said wall plate shell is provided with a plurality of cuts enabling said adapting sockets to be easily removed from or mounted to said wall plate shell without any tool.

3. A wall plate according to claim 2 wherein said cuts are symmetrically located on two inner opposite sides of said wall plate shell.

4. A wall plate according to claim 1, further comprising plural decorating covers capable of being installed upon said wall plate shell for concealing said fastener bases and hiding a part of said wall plate shell that lacks a said transmission-line adapting socket.

5. A wall plate according to claim 1 wherein one of said transmission-line connectors attaches thereto a medium piece capable of being fitted into an empty space of one of said transmission-line adapting sockets so that said one transmission-line connector can be removably mounted on said one transmission-line socket.

6. A wall plate according to claim 1, further provided with plural screw guides lying concealed at a back of said wall plate shell so that after said two fastener bases are removed from said wall shell, said wall plate can be mounted onto said wall surface thereby.

7. A wall plate according to claim 6 wherein said screw guides are integrally formed to said wall plate shell.

8. A wall plate according to claim 6 wherein said wall plate shell has screw covers provided above said screw guides and capable of respectively concealing screws screwed through said screw guides.

9. A wall plate according to claim 8 wherein said screw covers are engageable with said wall plate shell to be flush therewith.

10. A wall plate according to claim 8 wherein said shell has two said screw covers.

11. A wall plate according to claim 10 wherein said screw guides and screw covers are optionally and symmetrically located on said wall plate shell.

12. A wall plate according to claim 10 wherein said screw guides and said screw covers are diagonally oppositely located on said wall plate shell.

13. A wall plate according to claim 1 wherein said transmission-line connectors can be telephone-line connectors.

14. A wall plate according to claim 13, further comprising a dust cover capable of being provided upon one of said telephone-line sockets and being flush with said wall plate shell.

* * * * *